US006971386B2

(12) United States Patent
Duxbury

(10) Patent No.: US 6,971,386 B2
(45) **Date of Patent: *Dec. 6, 2005**

(54) PERSONAL RESPIRATOR

(76) Inventor: James Neil Duxbury, 3141 Shelly Graham Dr., Graham, NC (US) 27253

( * ) Notice: Subject to any disclaimer, the term of this patent is extended or adjusted under 35 U.S.C. 154(b) by 0 days.

This patent is subject to a terminal disclaimer.

(21) Appl. No.: 10/419,719

(22) Filed: Apr. 21, 2003

(65) Prior Publication Data

US 2004/0025878 A1 Feb. 12, 2004

Related U.S. Application Data

(63) Continuation of application No. 09/636,253, filed on Jul. 26, 2000, now Pat. No. 6,550,479.

(51) Int. Cl.[7] ..... A62B 7/10
(52) U.S. Cl. ..... 128/205.27; 128/205.29
(58) Field of Search ..... 128/201.18, 201.25, 128/201.26, 201.11, 202.18, 205.12, 205.27, 128/205.28, 205.29, 206.17, 206.15, 206.29, 128/206.19, 207.11, 202.27, 912

(56) References Cited

U.S. PATENT DOCUMENTS

| | | | | |
|---|---|---|---|---|
| 968,232 A | | 8/1910 | Bentz | |
| 1,196,539 A | | 8/1916 | Goldberg | |
| 1,270,404 A | * | 6/1918 | Garnett | 128/205.29 |
| 1,288,856 A | | 12/1918 | Farr | |
| 1,813,915 A | | 7/1931 | Cover | |
| 3,265,066 A | | 8/1966 | Katehis | |
| 3,266,490 A | * | 8/1966 | Klinger et al. | 128/206.15 |
| 4,061,140 A | | 12/1977 | Saito | |
| 4,090,511 A | * | 5/1978 | Gray | 128/201.18 |
| 4,154,234 A | * | 5/1979 | Baker | 128/205.12 |
| 4,207,882 A | | 6/1980 | Lemere | |
| 4,634,117 A | | 1/1987 | Kramer | |
| 4,781,184 A | * | 11/1988 | Fife | 128/205.12 |
| 4,878,491 A | | 11/1989 | McGilvray | |
| 4,915,105 A | | 4/1990 | Lee | |
| 4,938,211 A | | 7/1990 | Takahashi et al. | |
| 5,086,768 A | | 2/1992 | Niemeyer | |
| 5,485,832 A | | 1/1996 | Joffity | |
| 5,697,362 A | | 12/1997 | Albrecht | |
| 6,550,479 B1 | | 4/2003 | Duxbury | |

* cited by examiner

*Primary Examiner*—Mital Patel
(74) *Attorney, Agent, or Firm*—Harness, Dickey & Pierce, P.L.C

(57) ABSTRACT

A respiratory protection air-purifying device that minimizes the area required in front of the face, especially around the mouth area, by locating the heavier filter cartridge behind the head, resting on the lower neck and shoulders, connected by two filtered air tubes around the head and neck partially counter-balancing the valve chamber directly in front of the mouthpiece, forming a ring around the head with the mouthpiece in the mouth and the exhaust port in the bottom of the valve chamber. The valve chamber has the filtered air intake check type valves opposite each other horizontally, an exhaust check type valve down with short exhaust tube and an oval mouthpiece tube passing through the mouthpiece, into the mouth. The respirator is worn around the head and neck with the filter resting on the lower neck and shoulders, the mouthpiece inserted in the mouth.

21 Claims, 5 Drawing Sheets

PERSONAL RESPIRATOR

This is a continuation application claiming priority of Non-Provisional application Ser. No. 09/626,253 filed Jul. 26, 2000, now U.S. Pat. No. 6,550,479, the contents of which are incorporated herein by reference in their entirety.

BACKGROUND OF INVENTION

Personal respiratory protection has been recommended and required by both government and industry for many years. Studies have been made, standards set, and filtration developed to enable a worker to function in contaminated air with relative safety. However, due to the discomfort and restrictiveness of the respirator facemask, respirators are only worn when absolutely necessary and in many cases, hamper the capabilities and safety of the wearer. Respirators are also hot and heavy to wear, exerting pressure on sensitive areas of the face. They are impossible to wear properly with facial hair, sensitive skin, deep scars, or facial deformities. Respirators protrude in front of the face, limiting visibility and trapping large amounts of exhaled air that condenses on the face. They can not be worn with full-face shields, welding helmets or similar safety equipment.

The excessive dead air space, space between the mask and face, traps exhaled air. This air is hot, condenses on the face and is rebreathed when the wearer inhales. Thus the trapped air enters the lungs before any fresh filtered air and mixes with the residual air remaining in the lungs after exhalation. Retained carbon dioxide level in the lungs then rises, which can cause hyperventilation, diminished capacity to perform work and cardiac stress.

It is therefore the objective of this invention to address these conditions with structure designed to eliminate or minimize each problem. This will lend to greater comfort and safety for the user and consequently a greater likelihood that the user will wear the protective device and realize its benefits.

SUMMARY OF THE INVENTION

This Personal Respirator is a respiratory protective device. It consists of a mouthpiece that is a curved rubber-type flange. It is held in the user's mouth between the lips and the teeth with a flat oval airway tube extending from the center to a valve chamber. The valve chamber has a horizontal opening for the mouthpiece, an opening down for the exhaust check valve and two openings, one on the left and one on the right, for fresh filtered air check valves. Because the chamber is streamlined, of minimal diameter, with all three valves in close proximity and only open to the adjacently attached mouthpiece, the dead air space is extremely small. In this configuration, the dead air space can be limited to less than 14 milliliters. Such volume is substantially below existing respirators and well below the 100 milliliter level identified by the United States government.

The exhaust port has a flexible disk-type check valve that prevents air from entering when inhaling but allows exhaled air to flow out of the bottom of the chamber. It is further directed downward by the exhaust tube, thus eliminating fogging of glasses, safety glasses, face shields and welding helmets and takes with the exhaled breath, any condensate that might have collected in the small valve chamber and mouthpiece. The two horizontal filtered air tubes are connected with sleeves to the valve chamber with flexible disk-type check valves that allow filtered air to be drawn into the chamber from both sides when inhaling and both valves close when breath is exhaled. The filtered air tubes connect from the chamber valves to a "T" connection attaching both tubes together with a streamlined opening at 90 degrees, connecting into the threaded filter socket. The filter cartridge, a commercially available filter, will be required for use with this respirator. The type is selected to remove the particular contaminants in the area in which the respirator is to be worn. This threaded filter cartridge seats against a gasket in the base of the filter socket, all of which is located behind the head, resting on the back of the wearer's neck and upper shoulders.

The filter socket, air tubes and valve chamber form a ring, worn around the head. The heavier filter cartridge and socket rest in back on the lower neck and shoulders, counterbalancing the tubing, valve chamber and mouthpiece in front which is inserted in the mouth when in use. When not in use the mouthpiece being slightly heavier rests on the chest. The air tubes are semi-rigid tubing, with coupling sleeves that are detachable from the valve chamber. This allows the ring to separate and open up for easy installation and removal. A tethered nose clip installs over the nose insuring that the nostrils are safely closed airtight.

By drawing the air in from behind the neck, the intake is usually in a cleaner environment, thus making filtering easier and extending the life of the filter cartridges. Also, the heavy filter cartridge, filter socket, and much of the tubing weight are supported on the lower neck and shoulder area. Unlike the bulky facemask with the filter cartridge hanging on the front of the wearer's face, this design eliminates the weight problem. It also removes the face mask and filter cartridge from obstructing the wearer's vision, making it a definite improvement in safety to the operator. Supporting straps and elastic bands around the head are also eliminated, making it totally compatible with wearing a hard hat, winter clothing, safety equipment, and adds greatly to the convenience and comfort factors. When needed the respirator assembly is opened at the valve chamber connection to the air tube, slipped around the head, reconnected, the mouthpiece placed into the mouth and the nose clip installed. This forms a positive seal to the face and can be worn with large growths of facial hair, deep scars, deformed facial features, and does not irritate facial tissue. The front of the respirator is designed to be close to the face, which enables it to be worn with safety equipment, welding helmets, or full-face shields without restricting visibility or functionality.

This invention addresses with simply design, the problems that exist with respirators currently being used. By being more compatible and user friendly, the wearer will use the respirator longer without discomfort and be able to function in a safer manner. These advantages and objectives of the invention will be more fully apparent by reference to the drawings, briefly described hereafter, and the detailed description of the Respirator thereafter.

DETAILED DESCRIPTION OF THE PREFERRED EMBODIMENT

Figure 1:
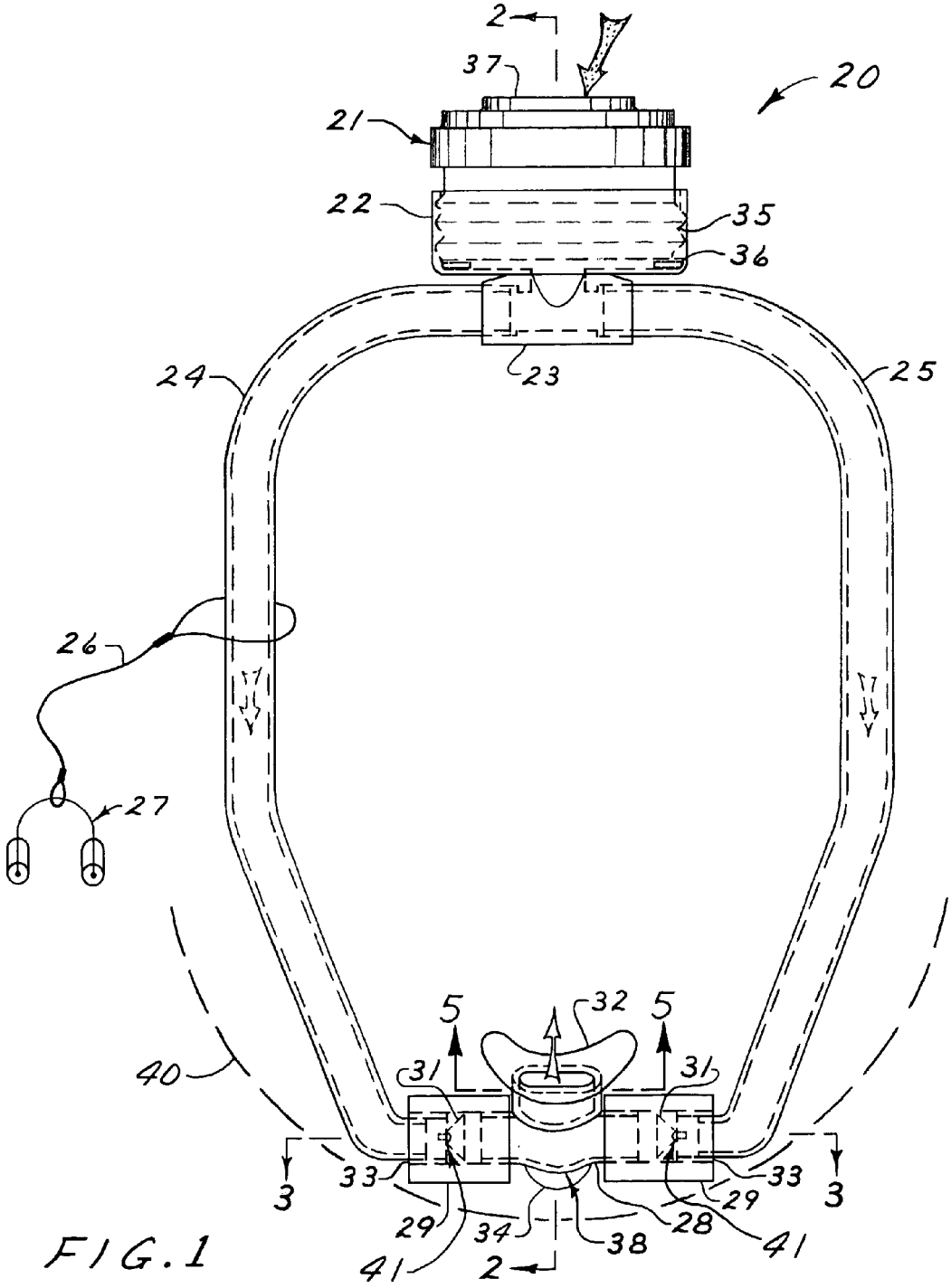
FIG. 1 is a plan view of the respirator in accordance with the present invention.
Figure 2:
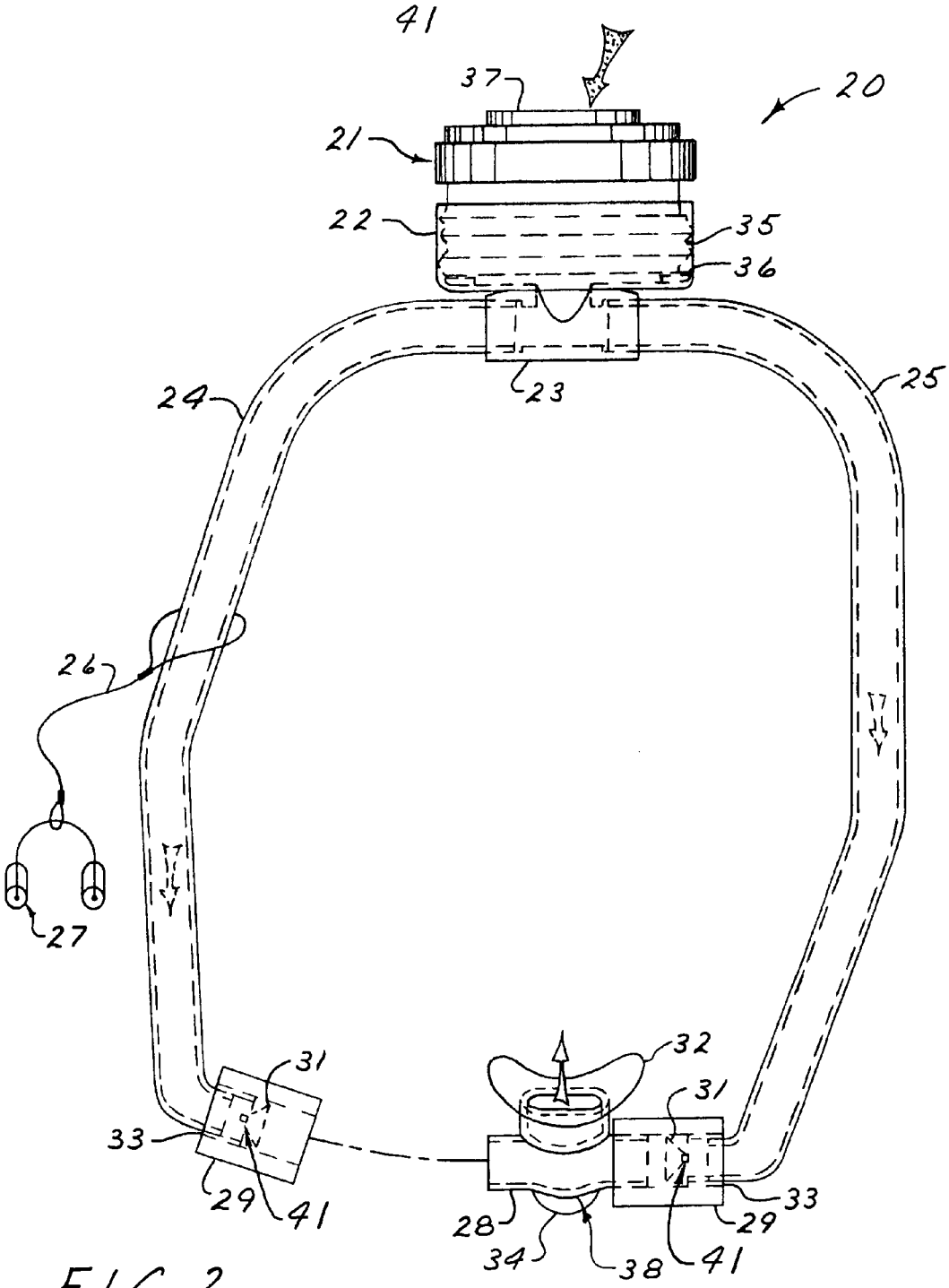
FIG. 2 is a plan view of the respirator in open, install, position.

Referring to the drawings with specific reference to FIG. 1 a personal respiratory protection device is designated by the numeral 20. Device 20 is installed from either side by separating the ring at sleeve 29, which is a press fit connection on a valve chamber body 28, thus slightly bending air tubes 24 and 25 as shown in FIG. 2. This allows the device 20 to easily be placed around the head, resting on the top of the shoulders. The sleeve 29 is then pressed back onto a valve chamber body 28 for a complete installation.

The mouthpiece is designed to interconnect the device 20 to the user. While this mouthpiece 32 can be of many forms, in the embodiment shown it is a substantially oval member having its longitudinal axis substantially in line with the longitudinal axis of the user's mouth. The mouthpiece 32 when inserted into the mouth between the teeth and lips, with the wearer's lips pressing down on the oval air tube of body 28, provides both support and an airway to valve chamber assembly 38. The substantially oval flange surrounding the mouthpiece 32 aids in the passage of air through the mouthpiece by blocking incidental air which would otherwise escape between the lips of the user and the mouthpiece. It has been found that a smaller flat flange works better than larger flat flanges by conforming and sealing to the mouth of the user. In the embodiment disclosed, the oval air tube is substantially ½" inch long with a 1⅛" wide by ¼" high internal free open area. This allows for a typical user to inhale and exhale without any adverse restriction or back-pressure. This is to be preferred. In other embodiments, a modified mouthpiece and/or modified flanges may be warranted in order to optimally interconnect the device to the mouth of the user.

The valve chamber assembly allows for the selective intake and discharge of air through the mouthpiece 32 of the user. It is preferred that this valve chamber assembly be located as close to the mouthpiece as possible both to minimize possible re-breathing of previously utilized air as well as to improve the actuation of the later described valve assembly. The valve chamber assembly 38 selectively allows filtered air to enter through the mouthpiece 32 when the wearer inhales and directs exhaled air out and downward. The exhaust port has a flexible disk-type check valve 42 that prevents air from entering when inhaling but allows exhaled air to flow out of the bottom of the chamber. It is further directed downward by the exhaust tube, thus eliminating fogging of the exhaled breath, any condensate that might have collected in the small valve chamber and mouthpiece.

The valve assembly 38 includes the valve chamber body 28 with four openings. One (previously described) is oval and extends just through mouthpiece 32 making an airway into the mouth. This flat oval airway of the valve chamber body 28 allows the mouth to function naturally and stops saliva that could drain from the mouth into the valve assembly 38. Also being oval, it provides a large flat airway that seals well and is comfortable to hold between the lips and front teeth. Two other openings are for filtered air supply. The two horizontal filtered air tubes are connected to the valve chamber body 28 with flexible disk-type check valves 41 that allow filtered air to be drawn into the valve chamber body 28 from both sides when inhaling and both valves 41 close when breath is exhaled. They are opposite each other at 90 degrees to the oval mouthpiece opening, one going left and the other going right. (see FIG. 3) The fourth opening, located below the mouthpiece opening, is directed downward and has a support member bisecting the opening with a flexible disk 39 attached to it by replaceable rivet 30 forming a check valve 42 that only lets exhaled air escape from body 28. The exhaled air is further directed downward by the short tube 34. This exhaust tube 34 in the embodiment disclosed is substantially ¾" I.D. round tube however in other embodiments a modified shape may be warranted to direct the exhausted air from the user. The two filtered air openings have similar check valves 41, wherein valve base 33 has a socket on one end for filtered air tubes 24 and 25 and a bisecting member with flexible disk 31 attached by replaceable rivet 30 on the other end. The valve bases 33 connect to one end of sleeves 29 while the other end of each sleeve is a detachable press fit coupling connection to valve chamber body 28. This is to be preferred. In other embodiments a modified check valve and/or sleeve connection may be warranted in order to optimally control the air flow function through the valve chamber body 28 and to facilitate ease of a specific installation.

Figure 3:
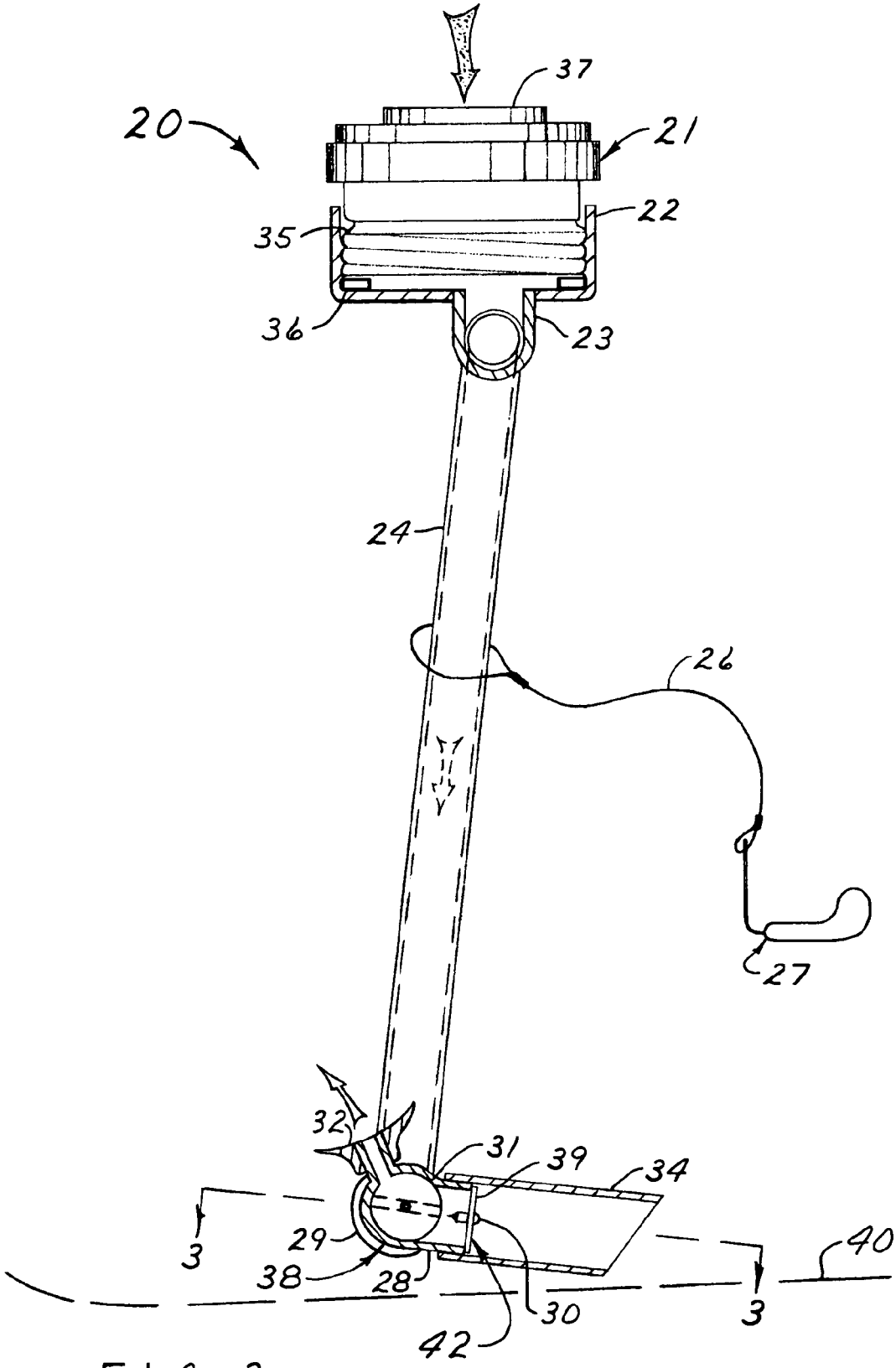
FIG. 3 is a cross-sectional view of the device of FIG. 1 taken along a line 2—2.
Figure 4:
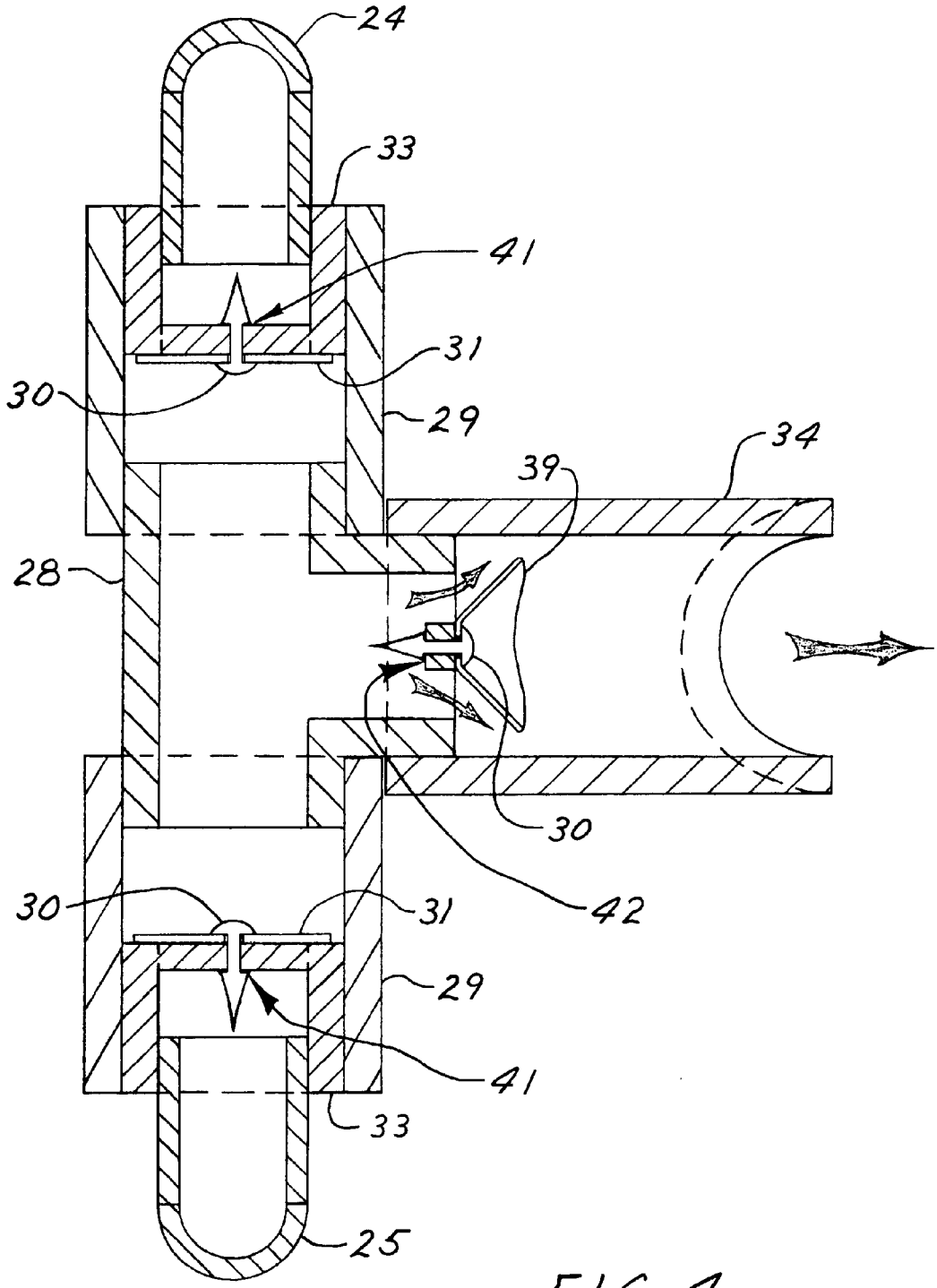
FIG. 4 is a cross-sectional view taken along line 3—3 of FIG. 1 and FIG. 3.
Figure 5:
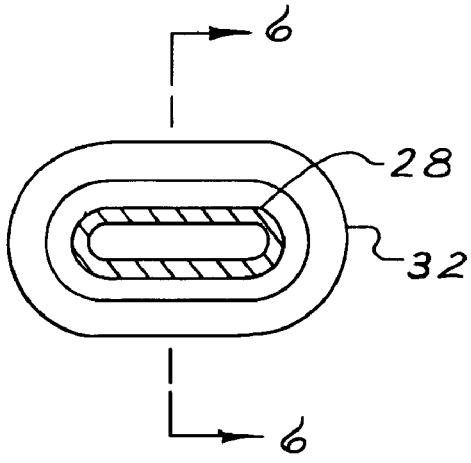
FIG. 5 is a cross-sectional view taken along line 5—5 of FIG. 1
Figure 6:
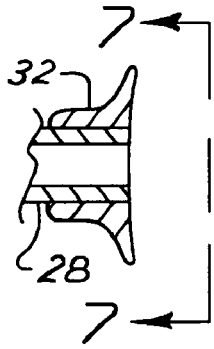
FIG. 6 is a cross-sectional view taken along line 6—6 of FIG. 5
Figure 7:
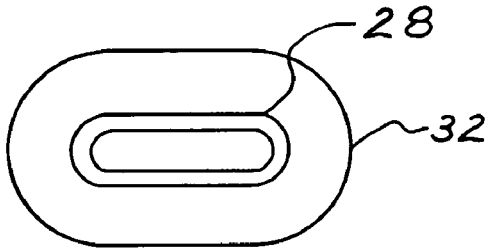
FIG 7 is a view taken along line 7—7 of FIG. 6.

The check valve disks 31 and 39 are shown in the inhale position, open and closed, respectively, on FIG. 1 and FIG. 3, and in the exhale position, closed and open, respectively on FIG. 4. Because the check valves 41 and 42 are of minimal diameter and located in such close proximity, the dead air space is much less than the comparable half mask respirators. Also the minimal distance from the mouthpiece 32 to valve assembly 38, and the small outside diameter holds the entire valve assembly 38 close to the face increasing visibility and comfort. The filtered air is drawn in through a filter cartridge 21. This filter cartridge is commercially available and is selected to remove the particular contaminants deemed hazardous to the wearer. The cartridge is not shown in detail since its internal details are not important to this invention. The filtered air tubes 24 and 25 as disclosed in the embodiment are semi-rigid, ½" internal dimension round vinyl tubing.

By drawing the air in from behind the neck, the intake is usually in a cleaner environment, thus making filtering easier and extending the life of the filter media itself. Also, the heavy filter cartridge, filter socket, and much of the tubing weight are supported on the lower neck and shoulder area. Unlike the bulky face mask with the filter cartridge hanging on the front of the wearer's face, this design eliminates the weight problem. It also removes the face mask and filter cartridge from obstructing the wearer's vision, making it a definite improvement in safety to the operator. Supporting straps and elastic bands around the head are also eliminated, making it totally gender free, compatible with wearing a hard hat, winter clothing, safety equipment, and adds greatly to the convenience and comfort factors. The mouthpiece when inserted forms a positive seal to the face and can be worn with large growths of facial hair, deep scars, deformed facial features, and does not irritate facial tissue. The front of the respirator is designed to be close to the face, which enables it to be worn with safety equipment, welding helmets, or full-face shields without restricting visibility or functionality. However, the filtered cartridge 21 has an intake opening 37 and a threaded base 35 which screws into filter socket 22 and seals against gasket 36. (See FIG. 3) The filter socket is attached to a "T" 23 which directs the filtered air out of socket 22 and through tube 24 on the right and tube 25 on the left of the head, to the valve assembly 38.

The nose clip 27 is used to clamp the nostrils airtight. It is a purchased item of known design and not part of this invention. The tether 26 is shown but is optional. With the nose clip 27 clamping the nostrils and mouthpiece 32 properly inserted into the wearer's mouth a positive seal is made to the mouth and unlike half mask respirators, can be worn with a full beard, deep scars and facial deformities. It also does not trap dead air and condensate against the face causing skin irritation, discomfort and consequently, lack of use.

Since the valve chamber 38 is close to the face and the filtered air tubes 24 and 25 turn back close to the head, the protrusions horizontally to the left and right are also minimal. This feature, along with the downwardly directed exhaled air tube 34, allows the respirator to be worn under most types of safety equipment such as welding helmets and full face shields (outline shown in representational form 40) with comfort and without fogging.

The valve chamber 38, filtered air tubes 24 and 25, and "T" 23 form a complete ring. This goes around the wearer's head, as previously described, with no straps, hooks or elastic bands. It rests on the shoulders with the heavy filter cartridge 21 and socket 22 behind the neck and the mouthpiece 32 in the mouth when in use and resting below on the chest, in a stand-by position, when not needed for short periods of time. This puts the heavy, bulky filter cartridge 21 and socket 22 behind the user, usually in a cleaner environment to draw air from, out of the way, out of sight, and actually helps to counter balance the weight of the mouthpiece 32 and valve assembly 38 by lifting them upward, pivoting on the clean air tubes 24 and 25 which rest on the top of the shoulders.

While preferred embodiments and particular applications of this invention have been shown and described, it is apparent to those skilled in the art that many other modifications and applications of this invention are possible without departing from the inventive concepts herein.

For example, it should be understood that while the personal respiratory device is shown in the drawings as having a single, circular, threaded filter cartridge configuration, the personal respirator device may use multiple filter cartridges, or different shape such as rectangular, octagon, or elliptical with compatible sockets and gasketing to be suitable for the purpose of the invention.

It is, therefore, to be understood that, within the scope of the appended claims, this invention maybe practiced otherwise than as specifically described, and the invention is not to be restricted excepted in the spirit of the appended claims. Though some of the features of the invention may be claims in dependence, each feature has merit if used independently.

What is claimed is:

1. A personal respiratory device for use in a human mouth having lips and teeth, said device comprising:

(a) a mouthpiece;

(b) a check-valve assembly having at least one air in-flow check valve and at least one air out-flow check valve, said check valve assembly connected to said mouthpiece;

(c) at least one air in-flow tube connected to said check valve assembly upstream of said air in-flow check valve; and (d) at least one air filter connected to said air in-flow tube, said at least one air filter in communication with ambient air wherein said personal respiratory device is counterbalanced by a weight distribution of said device, and wherein said (a) mouthpiece and said (b) check-valve assembly are counterbalanced by said (d) at least one air filter connected to said air in-flow tube about an axis posterior to said (a) mouthpiece and anterior to said (d) at least one filter connected to said air in-flow tube.

2. The device of claim 1, wherein said device comprises a pair of said air-inflow tubes.

3. The device of claim 2, wherein each of said pair of said air-inflow tubes is connected to said at least one air filter.

4. The device of claim 3 further comprising at least one air filter per air-inflow tube.

5. The device of claim 2, wherein said pair of said air-inflow tubes form a plane and wherein said mouthpiece is angled out of said plane.

6. The device of claim 2, wherein said pair of said air-inflow tubes form a plane and wherein said mouthpiece is connected to said check-valve assembly to permit said mouthpiece to be angled out of said plane.

7. The device of claim 2 further comprising a T connector connecting said air filter to said pair of said air-inflow tubes.

8. The device of claim 7, wherein said device forms a closed loop with said pair of air-inflow tubes, said check-valve assembly and said T connector.

9. The device of claim 8 further comprising a socket connecting said air filter to said T connector.

10. The device of claim 9, wherein said socket is threaded.

11. The device of claim 1, wherein said air filter is removably attached to said air in-flow tube.

12. The device of claim 1, wherein said at least one air-inflow tube is attached to said check-valve assembly via an air tight connection.

13. The device of claim 12 wherein said air tight connection is an air tight coupling.

14. The device of claim 1, wherein said mouthpiece comprises a flange sufficient to fit between said teeth and said lips.

15. The device of claim 14 wherein said flange is substantially flat.

16. The device of claim 15, wherein said flange is without a bitewing.

17. The device of claim 1, wherein said air out-flow check valve is inside an air exhaust tube.

18. The device of claim 17, wherein said air exhaust tube is pointed downward from said mouth.

19. The device of claim 1 further comprising a nose clip.

20. The device of claim 19, wherein said nose clip is provided on a tether.

21. The device of claim 1, wherein said device does not require any straps, hooks or bands to be held in place when worn for use.

* * * * *